US007201410B1

(12) United States Patent
Lassen

(10) Patent No.: US 7,201,410 B1
(45) Date of Patent: Apr. 10, 2007

(54) REUSABLE TAMPER EVIDENT SECURITY DEVICE

(75) Inventor: David Lassen, Arnold, MD (US)

(73) Assignee: The United States of America as represented by the National Security Agency, Washington, DC (US)

( * ) Notice: Subject to any disclaimer, the term of this patent is extended or adjusted under 35 U.S.C. 154(b) by 198 days.

(21) Appl. No.: 11/046,342

(22) Filed: Jan. 28, 2005

(51) Int. Cl.
*B65D 27/30* (2006.01)

(52) U.S. Cl. ..... 292/307 R; 292/307 A; 292/307 B; 292/329

(58) Field of Classification Search ..... 292/307 R, 292/307 A, 307 B, 329; 24/385, 418; 206/807; 220/266, 269
See application file for complete search history.

(56) References Cited

U.S. PATENT DOCUMENTS

| | | | | |
|---|---|---|---|---|
| 2,013,299 | A | 1/1935 | Byrne | |
| 4,602,405 | A * | 7/1986 | Sturman et al. | 24/385 |
| 5,188,582 | A * | 2/1993 | Ullman | 493/440 |
| 5,417,319 | A * | 5/1995 | Chalberg et al. | 206/1.5 |
| 5,452,930 | A | 9/1995 | Morgan | |
| 5,551,729 | A | 9/1996 | Morgan | |
| 5,568,951 | A * | 10/1996 | Morgan | 292/307 A |
| 5,883,576 | A * | 3/1999 | De La Huerga | 340/573.1 |
| 6,116,666 | A * | 9/2000 | Adamson et al. | 292/307 R |
| 6,933,847 | B2 * | 8/2005 | Feibelman | 340/572.1 |
| 7,129,841 | B2 * | 10/2006 | Feibelman | 340/568.1 |
| 2005/0156019 | A1 * | 7/2005 | Collingham | 229/125.37 |

* cited by examiner

*Primary Examiner*—Brian E. Glessner
*Assistant Examiner*—Mark Williams
(74) *Attorney, Agent, or Firm*—Eric Froehlich

(57) ABSTRACT

A reusable tamper-evident security device for use on a door or container includes a pair of base members, a pair of first leg members, a pair of second leg members, a pair of U-shaped upper members, and a pair of removable security label blanks. A base member, a first leg member, a second leg member, and a U-shaped upper member are abutted, form an inner cavity between the base member and the U-shaped upper member. At least one mounting hole is provided to affix the base member to the door or container. A first guide and a parallel second guide extent perpendicularly from the top surface of the base member, allowing the removable security label blank to be slidably inserted. The U-shaped upper member abutting each base member is oriented to form an oblong shape when the two base members are adjacent the other. An optional security label may be applied to the removable security label blank.

20 Claims, 6 Drawing Sheets

REUSABLE TAMPER EVIDENT SECURITY DEVICE

FIELD OF THE INVENTION

The present invention relates, in general, to a security fastener and in particular, to a tamper-evident seal.

BACKGROUND OF THE INVENTION

Protecting valuables is a very old problem. In simpler times, the owner of the valuables need only store valuables in a container or a closed room. More security could be obtained by adding a lock to the container or room. Locks may not provide the security the owner requires because an intruder may be able to open and close the lock without leaving any indication of the unauthorized entry.

Simple paper gummed seals are known in the art to solve this problem. With a simple paper gummed seal, the seal straddles the joint between the fixed portion of the container or a doorjamb, and the movable portion of the container or door. Before authorized entry is attempted, the owner inspects the paper seal for damage. To increase the security offered by paper seals, a signature is typically added to the paper seal. Simple paper seals can be removed easily, without tearing, and therefore do not provide adequate protection from unauthorized entry. The present invention is not limited in this regard.

U.S. Pat. No. 2,013,299, entitled "SEAL," discloses a two layer paper gummed seal. A first layer is designed to tear easily and a second layer is added that resists tearing. When used on a proper surface, an attempt to remove the first layer causes the first layer to separate from the second layer. As with all simple seals, the adhesive used must be able to adhere to the surfaces being protected. After each use, the adhesive must be completely removed before a new seal can be affixed. The present invention is not limited in either regard. U.S. Pat. No. 2,013,299 is hereby incorporated by reference into the specification of the present invention.

U.S. Pat. No. 5,551,729, entitled "TAMPER INDICATING DEVICE," discloses a multi-layer adhesive seal. A tamper-indicating pattern is applied to a layer between the top layer and the bottom adhesive layer. A signature may be added to the top layer. An attempt to peel off the seal reveals the tamper-indicating pattern of the intermediate layer. As with all adhesive seals, the adhesive used must be able to adhere to the surfaces being protected. After each use, the adhesive must be completely removed before a new seal can be affixed. The present invention is not limited in either regard. U.S. Pat. No. 5,551,729 is hereby incorporated by reference into the specification of the present invention.

U.S. Pat. Nos. 5,452,930 and 5,568,951, both entitled "TAMPER EVIDENT SECURITY DEVICE" disclose a device for securing a container with a fixed base and a movable closure portion, such as luggage. The device has a base member with a fixed portion, a movable access portion, and a recessed portion beneath the movable access portion. To secure the container, an elongated strap is secured to the movable closure and the ends of the elongated strap are restrained within the recessed portion beneath the movable portion of the base member. An adhesive label straddles the fixed portion and movable portion of the base member. Opening the device tears the label. After each use, the adhesive must be completely removed before a new seal can be affixed. The present invention is not limited in this regard.

U.S. Pat. Nos. 5,452,930 and 5,568,951 are hereby incorporated by reference into the specification of the present invention.

There exists a need for a high security multiple use tamper-evident device that may be applied to a variety of surfaces. There also exists a need for a high security tamper-evident device that does not require old adhesive from a security label to be removed before reuse of the tamper-evident device.

SUMMARY OF THE INVENTION

It is an object of the present invention to provide a reusable tamper-evident security device with enhanced protection against unauthorized entry. The tamper-evident device is designed to offer increased protection to an entry door or a container regardless of the surface condition. The tamper-evident device of the present invention provides increased protection for surfaces that are too rough, too slippery, or too old. A security seal may be applied to the reusable tamper-evident security device without removing the adhesive residue from a previous security seal.

A reusable tamper-evident security device according to the present invention has a pair of base members, a pair of first leg members, a pair of second leg members, a pair of U-shaped upper members, and a pair of removable security label blanks.

Each of the base members has a first side edge, a second side edge, a bottom edge, a top edge, and a top surface. A first guide extends a user-definable distance from the top edge, and perpendicularly along the top surface from the first side edge to the second side edge. A second guide extends perpendicularly along the top surface from the first side edge to the second side edge, and is spaced a user-definable distance from the first guide. Each base member also includes at least one mounting hole to secure the base member to the secured object.

Abutted and secured to each of the pair of base members is a first leg member. The first leg member has a user-definable length, a user-definable height, and at least one user-definable width. The first leg member extends lengthwise along the top surface of the base member, and is located along the first guide adjacent the top edge.

A second leg member is also abutted and secured to each of the pair of base members. The second leg member has a user-definable length, a user-definable height, and at least one user-definable width. The second leg member extends lengthwise along the top surface of the base member, and is located along the second guide adjacent the bottom edge.

Two U-shaped upper member, one for each of the pair of base members, have two parallel upper portions and a perpendicular base portion. One upper portion of the U-shaped upper member is oriented parallel to, and abutting the first leg member. The second upper portion of the U-shaped upper member is oriented parallel to, and abutting the second leg member. The base portion of one U-shaped upper member is oriented along the first side edge, while the base portion of the second U-shaped upper member is oriented along the second side edge.

In the preferred embodiment, the first leg member, the second leg member, and the U-shaped upper member are formed together from a single piece of aluminum. In addition, the area bound by the base member, the leg member, and the upper portion of the U-shaped upper member form a channel.

A pair of removable security label blanks, one per base member, have a user-definable thickness less than the user-definable thickness of the first leg member and second leg member. The removable security label blank slides on the first guide and the second guide, and covers substantially the entire area bound by the by the first side edge of the base member, the second side edge of the base member, the first leg member, and the second leg member. In the first alternate embodiment, the removable security label blank has two user-definable widths, which correspond to the distance between the user-defined widths of the first leg member and the second leg member. In the second alternate embodiment, the removable security label blank has three user-definable widths, which correspond to the distance between the user-defined widths of the first leg member and the second leg member.

In an alternate embodiment, a first depressed abutment section is located between the first guide and the top edge of the base member. A second depressed abutment section is located between the second guide and the bottom edge of the base member.

In an alternate embodiment, the base member further includes a depressed center section between the first guide and the second guide.

DETAILED DESCRIPTION

Figure 1:
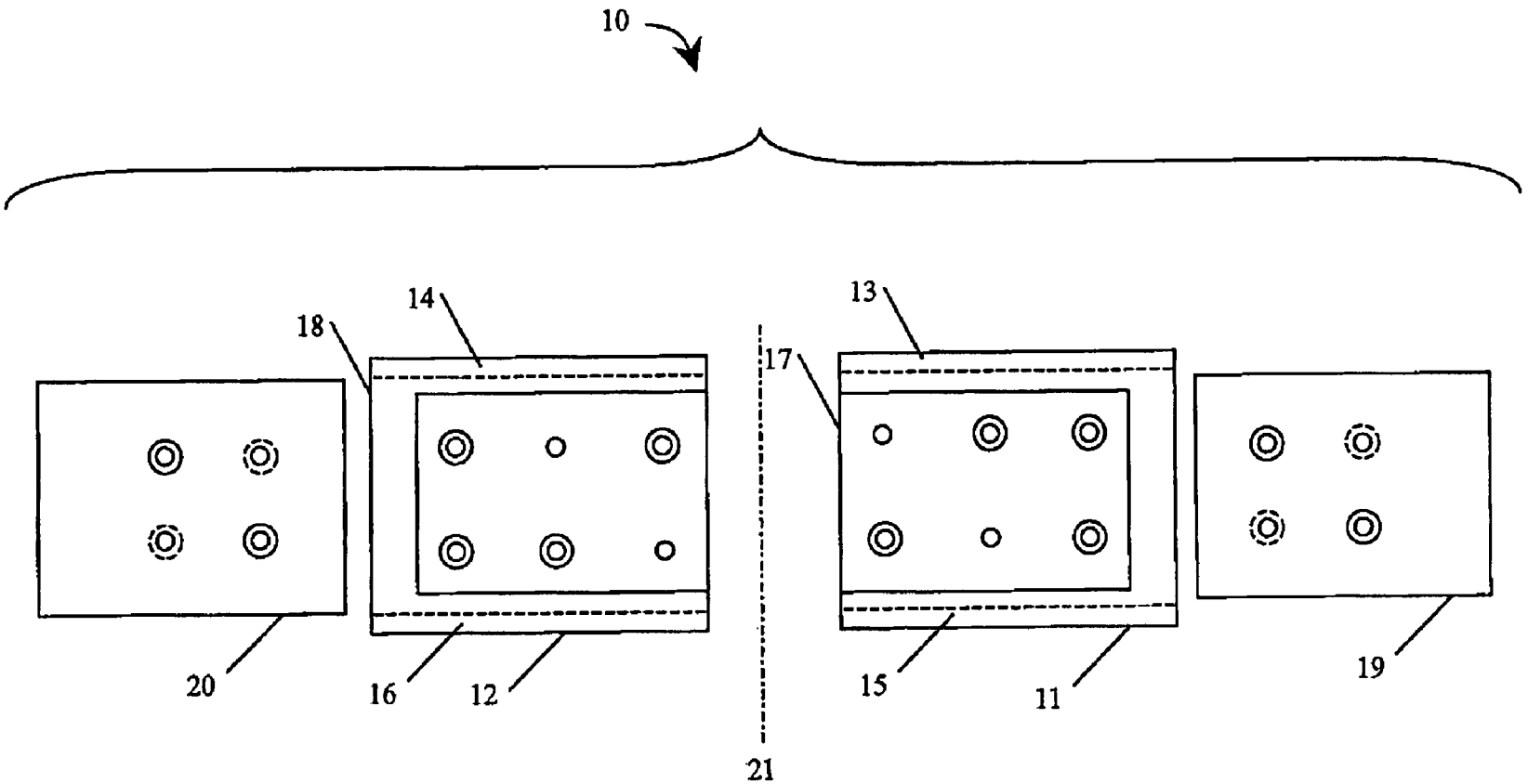
FIG. 1 is a front view of the first embodiment of the present invention.

Referring to FIG. 1, a reusable tamper-evident security device 10 according to the present invention is shown. The tamper-evident security device 10 has a pair of base members 11, 12, a pair of first leg members 13, 14, a pair of second leg members 15, 16, a pair of U-shaped upper members 17, 18, and a pair of removable security label blanks 19, 20. The reusable tamper-evident security device 10 is symmetrical about the centerline 21, and the remaining description of the reusable tamper-evident security device 10 will refer to one half of the reusable tamper-evident security device 10. The remaining half of the reusable tamper-evident security device 10 is constructed in an identical manner.

Figure 2:
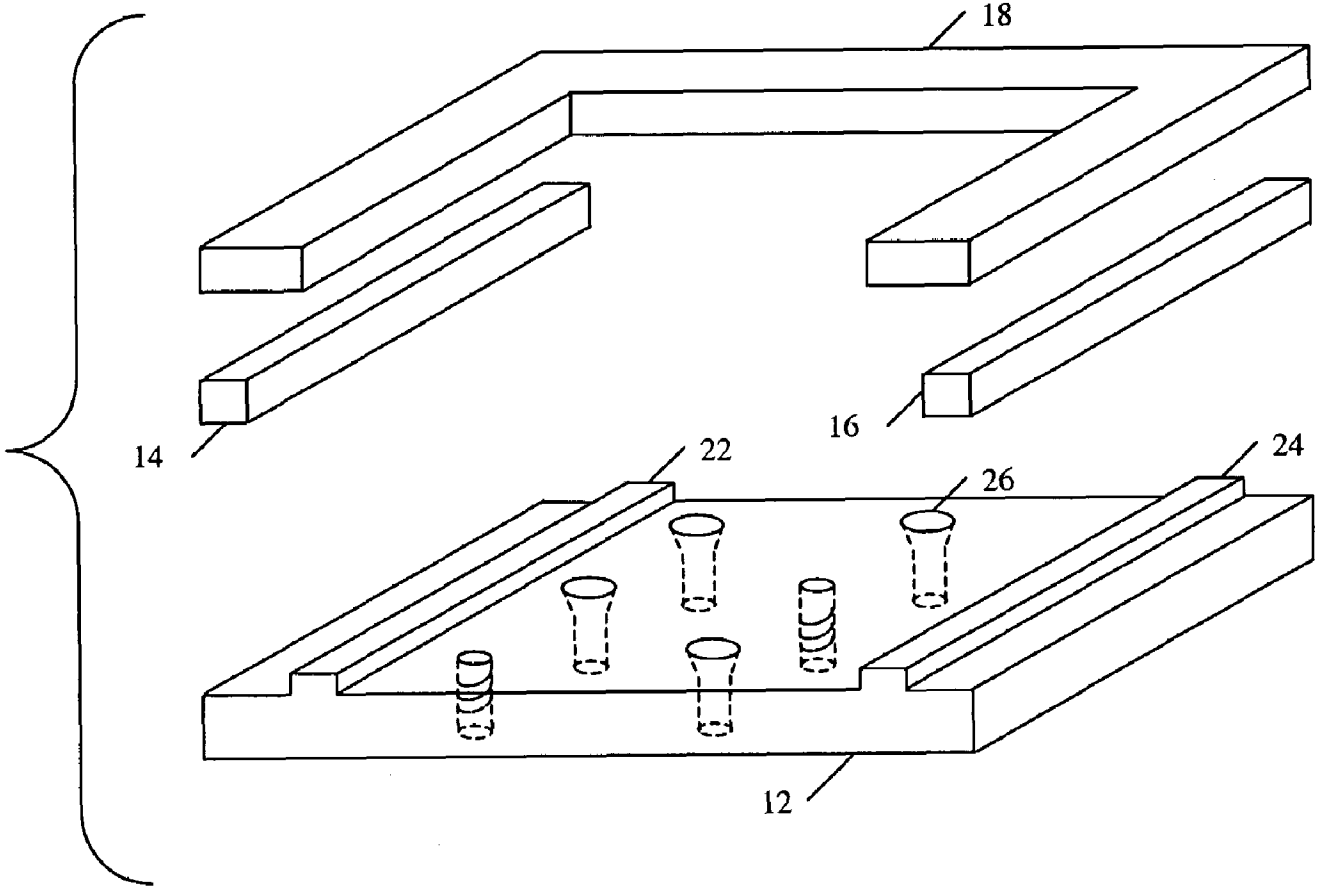
FIG. 2 is an exploded perspective view of one half of the present invention shown in FIG. 1.

Referring to FIG. 2, the base member 12 has a first side edge, a second side edge, a bottom edge, a top edge, and a top surface. A reusable tamper-evident security device of the present invention may be made in any size to accommodate larger, smaller, or different shaped tamper-evident labels. In practice, a generally square base member 12 has been found to work well. A base member 12 of 41.275 mm (1⅝ inches) square will accommodate a 1"×3" security label. While a generally square reusable tamper-evident security device 10 is shown, a reusable tamper-evident security device 10 of the present invention may be made in a variety of shapes, such as rectangular, round, or oblong without deviating from the scope of the invention.

In the preferred embodiment, the base member 12 is made of aluminum. Other materials may be used to manufacture the base members 12, such as steel, copper, titanium, wood, plastic, fiberglass, aramid fiber, acrylic resin, composite fiber, any equivalent material, and any combination thereof.

A first guide 22 extends along the top surface from the first side edge to the second side edge and spaced a user-definable distance from the top edge of the base member 12. The first guide 22 protrudes above the top surface of the base member 12.

A second guide 24 extends from the first side edge to the second side edge, and is parallel to, and spaced a user-definable distance from the first guide 22. Like the first guide 22, the second guide protrudes above the top surface of the base member 12.

Each base member 12 also includes at least one mounting hole 26 to secure the base member 12 to the secured object (not shown). In practice, four mounting holes have been found to work well, but those skilled in the art will recognize that a different number of mounting holes may be used. In the preferred embodiment, the at least one mounting hole 26 includes a countersink on the top surface of each of the pair of base members 12 permitting an obstruction free top surface. The base member 12 in the preferred embodiment also includes at least one threaded hole for releasably securing the removable security label blank 20 to the base member 12.

Abutted to each base member 12 is a first leg member 14. The first leg member 14 has a user-definable length, a user-definable height, and at least one user-definable width. The first leg member 14 extends lengthwise along the top surface of the base member from the first side edge to the second side edge, and is located along the top edge of the base member 12.

A second leg member 16 is also abutted to each base member 12. The second leg member 16 has a user-definable length, a user-definable height, and at least one user-definable width. The second leg member 16 extends lengthwise along the top surface of the base member 12 from the first side edge to the second side edge, and is located along the bottom edge of the base member 12.

Abutted to the first leg member 14 and the second leg member 16 is a U-shaped upper member 18. Each U-shaped upper member 18 has two parallel upper portions and a perpendicular base portion. One upper portion of the U-shaped upper member 18 is oriented parallel to, and abutting the first leg member 14. The second upper portion of the U-shaped upper member 18 is oriented parallel to, and abutting the second leg member 16. The base portion of one U-shaped upper member 18 is oriented along the first side edge portion, while the base portion of the second U-shaped upper member 18 is oriented along the second side edge portion. In the preferred embodiment, a user-definable portion of the base portion of the U-shaped upper member 18 has a reduced thickness to allow a security label (not shown) affixed to the removable security label blank 20 to slide underneath the base of the U-shaped upper member 18 without scratching the security label.

Figure 3:
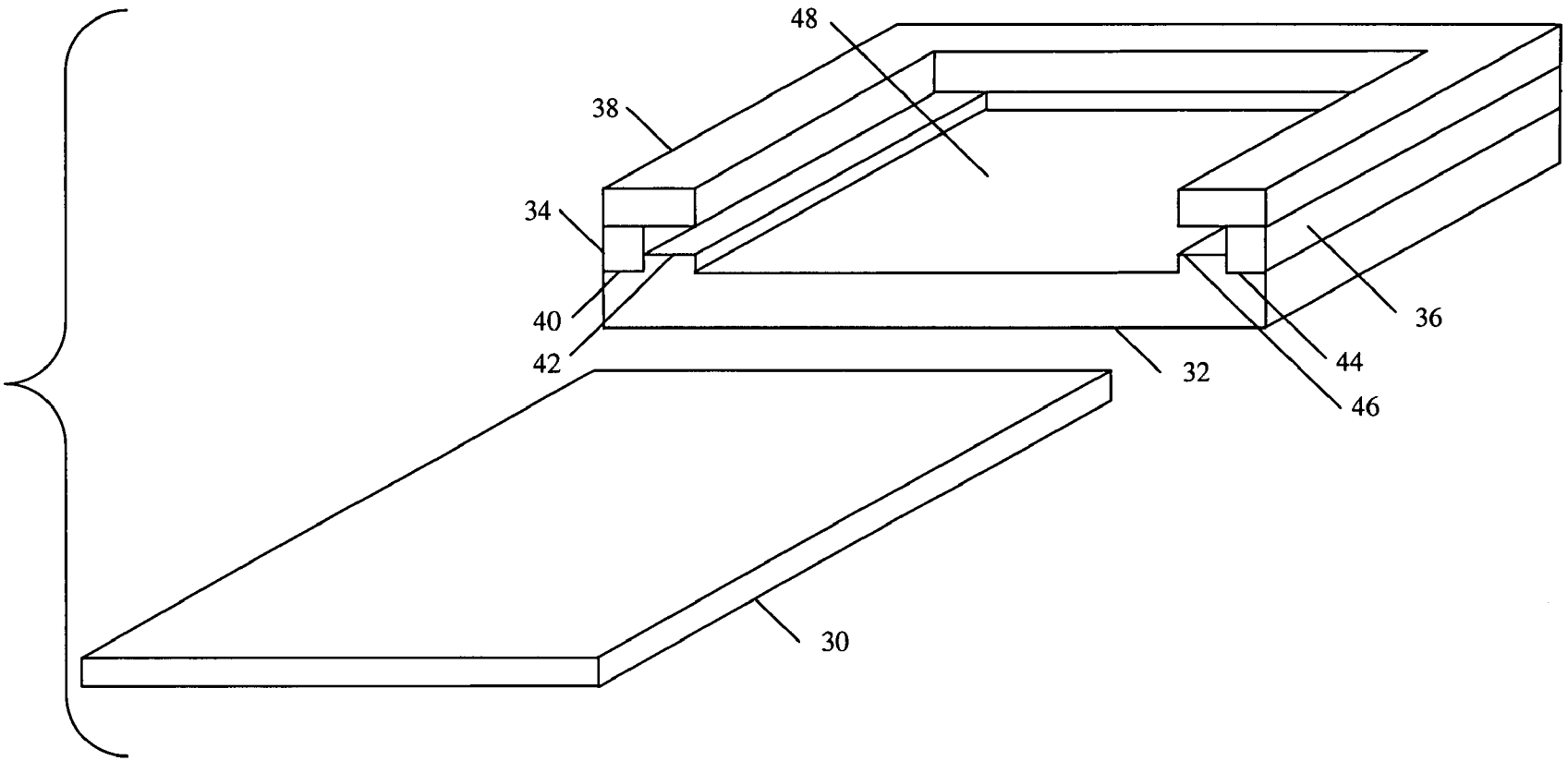
FIG. 3 is a perspective view of FIG. 2.

As shown in FIG. 3, a channel results between the base member 32, the first leg member 34, the second leg member 36, and the U-shaped upper member 38, restraining the removable security label blank 30. Those skilled in the art will recognize that the thickness of the U-shaped upper member 38 creates a lip above the removable security label blank 30, making removal of a security label (not shown) more difficult.

In the preferred embodiment, the first leg member 34, the second leg member 36, and the U-shaped upper member 38 are formed together from a single piece of aluminum. Other materials may be used to manufacture the first leg member 34, the second leg member 36, and the U-shaped upper member 38, such as steel, copper, titanium, wood, plastic, fiberglass, aramid fiber, acrylic resin, composite fiber, any equivalent material, and any combination thereof.

In an alternate embodiment, a first depressed abutment section 40 is located below the top surface of the base member 32. The first depressed abutment section 40 is located between the top edge of the base member 32 and the first guide 42, extending parallel to the first guide 42. A second depressed abutment section 44 is located between the bottom edge of the base member 32 and the second guide 46, extending parallel to the second guide 46. The first depressed abutment section 40 and the second depressed abutment section 44 provide a double right angle between the base member 32 and the first leg member 34 and between the base member 32 and the second leg member 36.

In another alternate embodiment, a depressed center section 48 is located between the first guide 42 and the second guide 46. The reduced center section provides clearance for a previous security label on the removable security label blank 30.

In the preferred embodiment, the first leg member 34, the second leg member 36, and the U-shaped upper member 38 are made of a single piece of aluminum. Preferably, the base member 32 is secured to the combination first leg member 34 and the second leg member 36, and U-shaped upper member 38 by mechanical fasteners, such as screws. Any mechanical fastener, such as screws, must be accessed from the back of the tamper-evident security device, so intruders cannot disassemble the security device. Other methods of attaching the pieces, such as a chemical adhesive or welding may also be used.

In an alternate embodiment, the tamper-evident security device is made as a single piece. Those persons skilled in the art will recognize that injection molding, casting, or machining can be used to make the base member 32, the first leg member 34, the second leg member 36, and the U-shaped upper member 38 as a single piece.

A removable security label blank 30, has a user-definable thickness. Preferably, the user-definable thickness is less than the user-definable thickness of the first leg member 34 and second leg member 36. In practice, a thickness of 1.58 mm (1/16") has been found to work well.

The removable security label blank 30 slides along the first guide 42 and the second guide 44, and covers substantially the entire area bound by the by the first side edge of the base member 32, the second side edge of the base member 32, the first leg member 34, and the second leg member 36. Preferably, a security label (not shown) is affixed to the removable security label blank after at least one screw is used to releasably secure the removable security label blank 30 to the base member 32. After the first use, the removable security label blank 30 may be reversed, permitting a second, subsequent use of the removable security label blank 30. Used removable security label blanks 30 may be discarded after use, saved for a user-definable time period, or cleaned of the old security label and reused.

In the preferred embodiment, the removable security label blank 30 is made of aluminum. Alternatively, the removable security label blank 30 may be made of steel, copper, titanium, wood, plastic, fiberglass, aramid fiber, acrylic resin, composite fiber, any equivalent material, and any combination thereof.

Optionally, at least one identifier may be provided on the removable security label blank 30. Those persons skilled in the art will recognize the at least one identifier may be selected from the group of identifiers consisting of a printed code, a holographic image, a Radio Frequency Identification tag, a magnetic strip, a capacitive sensor, a user-definable indicia, any equivalent identifier, and any combination thereof.

In an alternate embodiment, a portion of the removable security label blank 30 extends beyond the side edge of the base member 32 opposite the base portion of the U-shaped upper member 38.

Although a generally rectangular shape for the removable security label blank 30 is shown, those persons skilled in the art will recognize that other geometric shapes may be used to match the base member 32.

In an alternate embodiment, the edge of the removable security label blank 30 along the side edge of the base member 32 opposite the base portion of the U-shaped upper member 38 may be nonlinear to facilitate interleaving one removable security label blank 30 with another removable security label blank 30 of the opposing base member 32.

Figure 4:
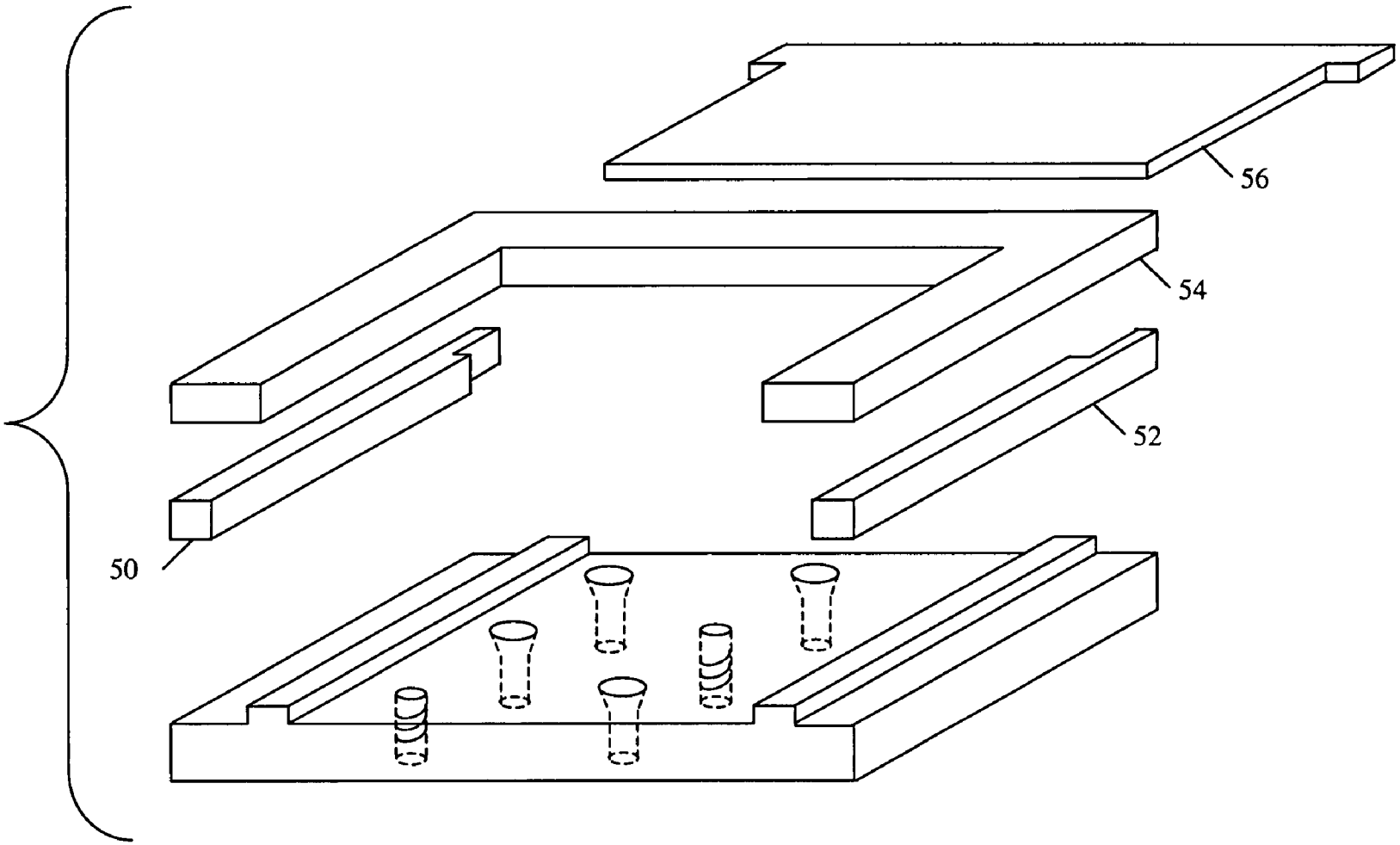
FIG. 4 is a perspective view of an alternate embodiment of the present invention.

As shown in FIG. 4, in an alternate embodiment the first leg member 50 and the second leg member 52 have two user-definable widths. Those persons skilled in the art will recognize that more than two user-definable widths can be used. For instance, three, four, or more widths, each spaced a user-definable distance from the other user-definable widths can be used.

The two user defined widths correspond to the distance between two user-defined widths of the first leg member 54 and the second leg member 56. In this alternate embodiment, the first leg member 54 and the second leg member 56 have a reduced width along the base portion of the U-shaped upper member 54. The removable security label blank 56 has a corresponding T-shape that cooperates with the two user-defined widths of the first leg member 54 and the second leg member 56, and limits the user to inserting the removable security label blank 54 from one direction.

Figure 5:
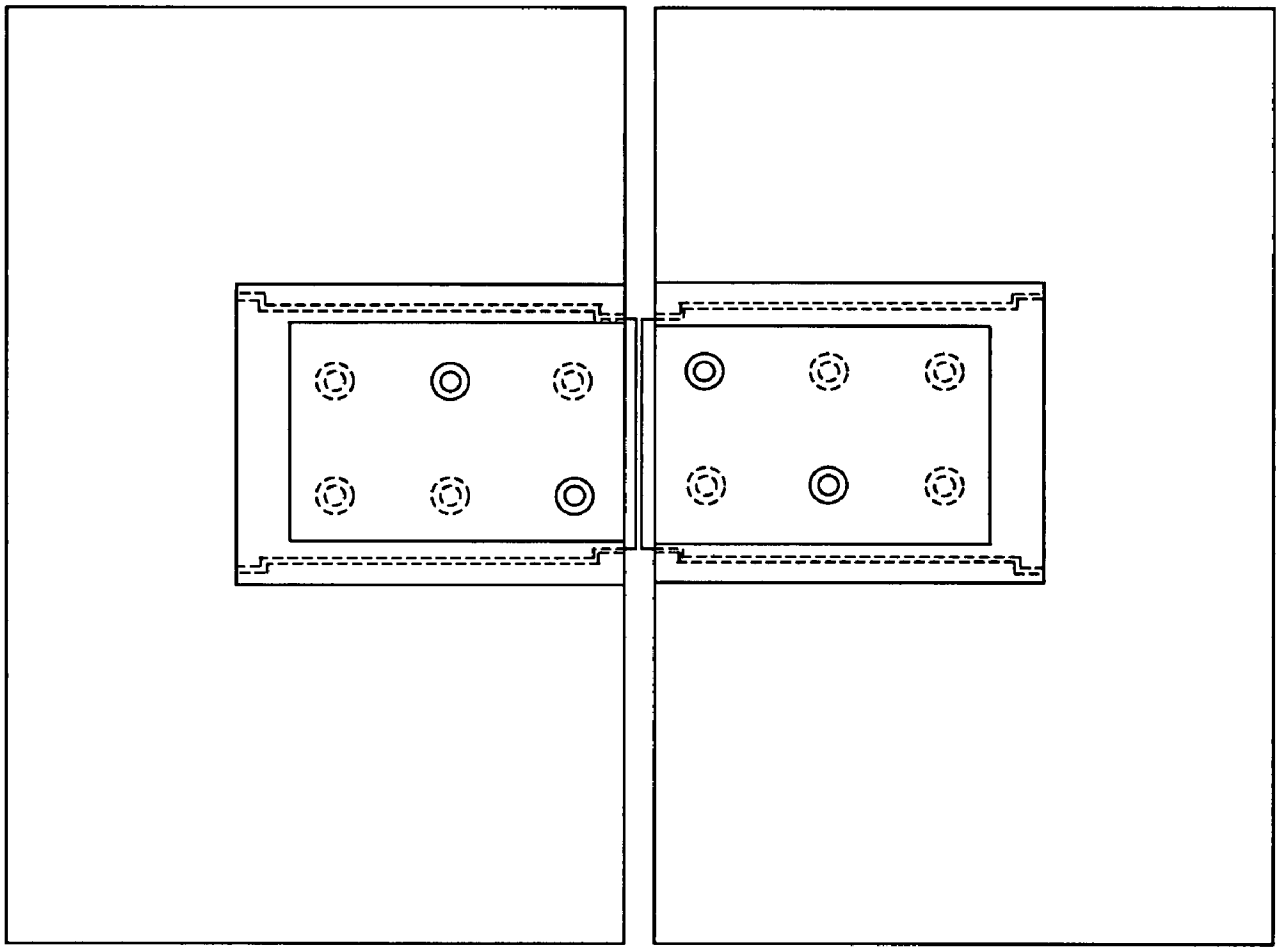
FIG. 5 is a front view of a typical installation of the second alternate embodiment of the present invention.

As shown in FIG. 5, to use the present invention, the owner of the container or room positions the base members so the upper portions of the U-shaped upper members are aligned. The base members may be positioned linearly along the walls of a container or a double door, or at a right angle for the wall and lid of a container or a single door. In the preferred embodiment, at least one mechanical fastener is used to secure the base to the container or door. Optionally, an adhesive or chemical process may be used, although the use of a chemical or adhesive may reduce the security provided by the tamper-evident security device.

The tamper-evident security device of the present invention provides a convenient surface to mount security labels, regardless of the surface condition. Those persons skilled in the art will recognize that some surfaces, such as concrete, brick, leather, and wood do not permit good adhesion of the security label. The present invention also permits surfaces that are slippery, greasy, or oily, and the like to be protected without the time consuming step of cleaning or roughening-up the surface.

After the door is closed, a removable security label blank is slidably inserted into each base member under the base of the U-shaped upper member, and restrained in the groove along the upper portion of the U-shaped upper member. In the preferred embodiment, at least one mechanical fastener is used to secure the removable security label blank to the base member. Preferably, a security label is applied to the removable security label blank.

Figure 6:
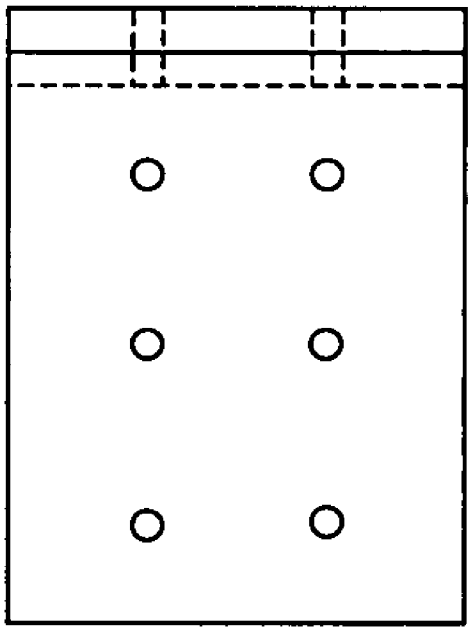
FIG. 6 is side view of a typical drill guide for the present invention.
Figure 7:
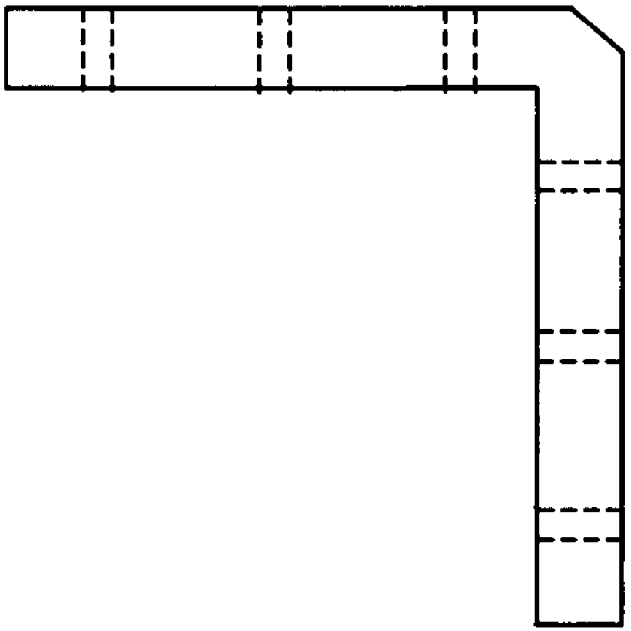
FIG. 7 is a top view of the drill guide shown in FIG. 6.

As shown in FIG. 6 and FIG. 7, a drill guide may be used to permit rapid installation of the reusable tamper-evident security device of the present invention. Mounting holes spaced one half of an inch apart have been found to work well in practice.

While the preferred embodiments of the invention have been illustrated and described, it will be apparent to those of ordinary skill in the art that various changes and modifications may be made without deviating from the inventive concepts set forth above.

What is claimed is:

1. A tamper-evident security device, comprising:

a) a pair of base members, each of said pair of base members having a first side edge, a second side edge, a top edge, a bottom edge, a top surface, and at least one mounting hole;

b) a first guide, said first guide abutting the top surface of each one of said pair of base members, the first guide extending from the first side edge of said base member to the second side edge of said base member, and said first guide spaced a user-definable distance away from the top edge;

c) a second guide, said second guide abutting the top surface of each one of said pair of base members, the second guide extending from the first side edge of the base member to the second side edge of the base member, and said second guide spaced a user-definable distance from, and parallel to, said first guide;

d) two first leg members, one of said pair of first leg members for each one of said pair of base members, said first leg member having a user-definable length, at least one user-definable width and a user-definable height, said first leg member abutting said each of said pair of base members and extending lengthwise along the top surface of said pair of base members, and located between the top edge and the first guide;

e) two second leg members, one of said pair of second leg members for each one of said pair of base members, said second leg member having a user-definable length, at least one user-definable width and a user-definable height, said second leg member abutting said each of said pair of base member and extending lengthwise along the top surface of said pair of base members, and located between the bottom edge and the second guide;

f) two U-shaped upper members, one for each of said pair of base members, said pair of U-shaped upper member having two parallel upper portions and a perpendicular base, the upper portions of both of said U-shaped upper member oriented parallel to and abutting said first leg member and said second leg member, the base of one U-shaped upper member oriented along the first side edge of one of said base member and the second U-shaped upper member oriented along the second side edge of the second of said base member; and g) two removable security label blanks, one for each of said pair of base members, said removable security label blank having a user-definable thickness, said removable security label blank slideably positioned on said first guide and said second guide, and covering substantially the entire area bound by the first side edge of said pair of base member, the second side edge of said base member, the first leg member, and the second leg member.

2. The device of claim 1, further comprising a first depressed abutment section below the top surface of said pair of base members, between the top edge and the first guide, and a second depressed abutment section below the top surface of said pair of base members, between the bottom edge and the second guide.

3. The device of claim 2, wherein each of said pair of base members further comprises a depressed center section below the top surface of said pair of base members, between the first guide and the second guide.

4. The device of claim 3, wherein said removable security label blank for each of said pair of base members further comprises a user-definable portion forming a geometric shape, said geometric shape cooperating with the at least one user-definable width of said user-first leg member and said second leg member.

5. The device of claim 4, wherein at least one of said at least one mounting hole in said base member is threaded.

6. The device of claim 5, wherein said removable security label blank includes at least one hole therethrough.

7. The device of claim 6, wherein a portion of said removable security label blank extends a user-definable distance beyond the side edge portion of said pair of base members.

8. The device of claim 7, wherein said removable security label blank further comprises at least one identifier, where said at least one identifier is selected from the group of identifiers consisting of a printed code, a holographic image, a Radio Frequency Identification tag, a magnetic strip, a capacitive sensor, a user-definable indicia, any equivalent identifier, and any combination thereof.

9. The device of claim 8, further comprising a security label, said security label extending from one removable security label blank to a second removable security label blank, said security label covering substantially all of the space bound by the two U-shaped upper members.

10. The device of claim 9, wherein said base member, said first leg member, said second leg member, and said two U-shaped upper members are constructed from a material selected from the group of materials consisting of steel, aluminum, copper, titanium, wood, plastic, fiberglass, aramid fiber, acrylic resin, composite fiber, any equivalent material, and any combination thereof.

11. The device of claim 10, wherein said removable security label blank has a user-definable thickness, said user-definable thickness less than the user-definable height of said first leg member and said second leg member and at least one user-definable width.

12. The device of claim 1, wherein each of said pair of base members further comprises a depressed center section below the top surface of said pair of base members, between the first guide and the second guide.

13. The device of claim 1, wherein said removable security label blank for each of said pair of base members further comprises a user-definable portion forming a geometric shape, said geometric shape cooperating with the at least one user-definable width of said user-first leg member and said second leg member.

14. The device of claim 1, wherein at least one of said at least one mounting hole in said base member is threaded.

15. The device of claim 1, wherein said removable security label blank includes at least one hole therethrough.

16. The device of claim 1, wherein a portion of said removable security label blank extends a user-definable distance beyond the side edge portion of said pair of base members.

17. The device of claim 1, wherein said removable security label blank further comprises at least one identifier, where said at least one identifier is selected from the group of identifiers consisting of a printed code, a holographic image, a Radio Frequency Identification tag, a magnetic strip, a capacitive sensor, a user-definable indicia, any equivalent identifier, and any combination thereof.

18. The device of claim 1, further comprising a security label, said security label extending from one removable security label blank to a second removable security label blank, said security label covering substantially all of the space bound by the two U-shaped upper members.

19. The device of claim 1, wherein said base member, said first leg member, said second leg member, and said two U-shaped upper members are constructed from a material selected from the group of materials consisting of steel, aluminum, copper, titanium, wood, plastic, fiberglass, aramid fiber, acrylic resin, composite fiber, any equivalent material, and any combination thereof.

20. The device of claim 1, wherein said removable security label blank has a user-definable thickness, said user-definable thickness less than the user-definable height of said first leg member and said second leg member and at least one user-definable width.

* * * * *